US009791201B1

(12) United States Patent
Howard

(10) Patent No.: US 9,791,201 B1
(45) Date of Patent: Oct. 17, 2017

(54) SPIRAL CHILLER APPARATUS AND METHOD OF CHILLING

(75) Inventor: David Howard, Kellyville, OK (US)

(73) Assignee: Unitherm Food Systems, LLC, Bristow, OK (US)

( * ) Notice: Subject to any disclaimer, the term of this patent is extended or adjusted under 35 U.S.C. 154(b) by 1174 days.

(21) Appl. No.: 12/728,678

(22) Filed: Mar. 22, 2010

(51) Int. Cl.
*F25D 17/02* (2006.01)
*F25D 3/11* (2006.01)
*F25D 25/04* (2006.01)
*F25D 25/02* (2006.01)

(52) U.S. Cl.
CPC ..... *F25D 3/11* (2013.01); *F25D 25/04* (2013.01); *F25D 25/027* (2013.01)

(58) Field of Classification Search
CPC ..... F25D 3/11; F25D 25/04; F25D 25/027
USPC ..... 62/374, 380, 381
See application file for complete search history.

(56) References Cited

U.S. PATENT DOCUMENTS 3,866,432 A * 2/1975 Harrison ..... F25D 25/04 198/778
3,873,755 A 3/1975 McKay
4,354,815 A 10/1982 Bardsley et al.
4,480,535 A * 11/1984 Jaxmar et al. ..... 99/476
4,582,484 A 4/1986 Sandor
4,829,158 A 5/1989 Burnham
4,866,946 A * 9/1989 Klee ..... 62/63
4,957,756 A 9/1990 Olander et al.
5,020,330 A * 6/1991 Rhoades et al. ..... 62/63
5,078,120 A 1/1992 Hwang
5,170,631 A * 12/1992 Lang ..... F25D 25/04 62/332
5,203,820 A * 4/1993 Dibbs ..... 62/381
5,205,135 A * 4/1993 Lang ..... 62/381
5,343,714 A * 9/1994 Kiczek et al. ..... 62/381
5,410,886 A * 5/1995 Wallace et al. ..... 62/63
5,452,588 A * 9/1995 Onodera ..... 62/381
5,520,944 A 5/1996 Richardson et al.
5,694,835 A 12/1997 Mangina
5,997,925 A 12/1999 Wilson et al.
6,006,536 A * 12/1999 Ochs ..... 62/378
6,045,841 A 4/2000 Singh
6,146,678 A 11/2000 Caridis et al.
6,713,106 B1 3/2004 Underwood et al.
7,107,899 B2 9/2006 Nothum, Jr.
2004/0096555 A1 5/2004 Gould
2005/0092730 A1 5/2005 Nothum
2006/0032382 A1 2/2006 Nothum
(Continued)

OTHER PUBLICATIONS

FMC Foodtech, "Superior Cross-Belt Temeprature Control Improves Bacon Processing", Dec. 5, 2007, Publisher: FMC Technologies, Inc., Published in: US.
(Continued)

*Primary Examiner* — David Teitelbaum
(74) *Attorney, Agent, or Firm* — GableGotwals

(57) ABSTRACT

A spiral chiller and a method of chilling a food product in a spiral chiller using a cooling medium wherein (a) the food product is conveyed within the chiller by a spiral conveyor having a plurality of spiral flutes and (b) the cooling medium is discharged either upwardly and/or downwardly within, and/or laterally into, one or more vertical gaps between adjacent pairs of spiral flutes using one or more delivery duct structures which extend inside the interior of the product chilling chamber.

1 Claim, 5 Drawing Sheets

(56) References Cited

U.S. PATENT DOCUMENTS

| | | | |
|---|---|---|---|
| 2006/0207436 | A1 | 9/2006 | Nothum |
| 2007/0023413 | A1 | 2/2007 | Wilson |

OTHER PUBLICATIONS

Ahmed Elamin, "Spiral Oven Reduces Operating Costs, Claims Manufacturer", Dec. 6, 2007, Publisher: Decisionnewsmedia, Published in: US.

Howard, Pending U.S. Appl. No. 12/559,793 for "Spiral Oven Apparatus and Method of Cooking", filed Sep. 15, 2009.

Howard, Pending U.S. Appl. No. 12/716,517, for "Spiral Apparatus and Method for Temperature Processing of Food Products", filed Mar. 3, 2010.

* cited by examiner

SPIRAL CHILLER APPARATUS AND METHOD OF CHILLING

FIELD OF THE INVENTION

The present invention relates to spiral chillers and to methods of cooling, freezing, and crust-freezing food products therein.

BACKGROUND OF THE INVENTION

A prior art spiral chiller 2 used for cooling and freezing food products is schematically illustrated in FIG. 1. The prior art spiral chiller 2 comprises: a housing 4 having a lower product chilling chamber 6 and an upper circulation and cooling chamber 8; a spiral conveyor belt 10 within the product chilling chamber 6 for carrying the food product during the cooling process; a chamber ceiling 12 which separates the product chilling chamber 6 from the upper circulation and cooling chamber 8; an upper side opening 11 in a sidewall of the product chilling chamber 6 through which the upper end (typically an outfeed section) 13 of the conveyor 10 extends; a lower sidewall opening 15 through which the lower end (typically an infeed section) 17 of the spiral conveyor 10 extends; a circulation fan 14 for circulating a cooling medium (e.g., air) 5 through the spiral chiller 2; an exterior fan motor 19; one or more indirect heat exchangers, refrigerating elements, or other cooling devices 21 within the upper circulation and cooling chamber 8 for cooling the cooling medium 5.

In operation, the food cooling medium 5 is delivered by the circulation fan 14 through the cooling device 21 provided in the upper chamber 8 and then is discharged vertically downward into the product chilling chamber 6 via either one or more openings in the chamber ceiling 12 or one or more discharge cones 23 extending a short distance downwardly into the product chilling chamber 6 above the elevation of the upper end 13 of the conveyor 10. Within the cooling chamber 6, the circulation fan 14 operates to draw the cooling medium 5 inwardly across the 360° spiral flites 18 for convective cooling and then into a vertical return flow path 20 which is surrounded by the spiral conveyor 10.

The spiral conveyor 10 can convey the food product 16 either upwardly or downwardly in the chilling chamber 6 during the cooling or freezing process but will typically convey the food product 16 upwardly. The spiral conveyor 10 has an axis of rotation (i.e., an axis of spiral travel) 24, typically also corresponding to the longitudinal axis of the vertical return flow passageway 20, around which the food product 16 is conveyed as it is contacted by the cooling medium 5 during the cooling process.

In another type of prior art spiral chiller, a plenum is provided outside of one or two side walls of the product chilling chamber to draw the cooling medium out of the product chilling chamber. Typically, the side wall of the product chilling chamber will have openings therethrough and will constitute the inner wall of the plenum. The chiller circulation fan(s) will also typically be located inside the plenum.

Heretofore, spiral chillers have had significant shortcomings which have significantly limited the types of chilling operations which can be performed in these chillers and have resulted in (a) significantly non-uniform flow, temperature, and chilling conditions within the product chilling chamber 6 and (b) non-uniform chilling results which vary, for example, depending upon whether the food product is conveyed near the inside edge 28, near the outside edge 26, or on the central portion of the spiral conveyor belt 10.

As seen in FIG. 1, the circulation fan 14 of the prior art system 2 operates to draw the cooling medium return flow 27 upwardly through the center of the cooking chamber ceiling 12 and then operates to discharge the cold cooling medium 5 vertically downward into the uppermost end of the product chilling chamber 6 through the one or more ceiling openings or cones 23. As will be apparent, the path of least resistance (i.e., the path of lowest pressure drop) is for the cooling medium to simply flow directly through the upper portion of the product chilling chamber 6 from the ceiling opening(s) or cone(s) 23 to the circulation fan 14. Consequently, flow rates and temperatures in the lower regions of the product chilling chamber 6 can be significantly lower than the flow rates and temperatures experienced in the upper regions of the product chilling chamber 6. In addition, temperatures in the lower regions can be significantly less cool than in the upper regions.

Also, as would be expected with a circulation system of this nature, dead zones are commonly created at various locations within the product chilling chamber 6 where the cooling medium 5 does not freely circulate. Further, the flow patterns which occur across the belt from the outside edge 26 to inside edge 28 can result in the food products placed toward the interior edge 28 of the belt receiving less beneficial heat transfer than the products placed toward the outer edge 26 of the belt, especially in the lower regions of the product chilling chamber 6 where lower cooling medium flow rates are experienced. This, in turn, can result in significant differences in cooling uniformity and product appearance.

The limited and non-uniform cooling flow circulation systems and patterns provided by the prior art spiral chiller 2 also result in slower cooling and freezing times and reduced product throughput. Because the cooling medium flow rate through the lower regions of the product chilling chamber 6 is significantly less than the flow rate in the upper regions of the product chilling chamber 6, much less cooling occurs in the lower regions than in the upper regions. Consequently, the conveyor rate must be slowed so that the product 16 is allowed to spend more time in the upper regions of the product chilling chamber 6 than would otherwise be required if the same flow rates and temperatures were experienced in the lower regions of the chiller. Further, the conveyor throughput rate must also be slowed to ensure that the product placed closest to the inner edge 28 of the spiral conveyor belt 10 is adequately chilled.

In addition, the available cooling and freezing applications for the prior art spiral chiller 2 have also been further significantly restricted because the prior art spiral chiller 2 is limited to the lateral flow of the cooling medium across the spiral flites 18 of the chiller 2. Heretofore, for example, to obtain any impingement effects which might be beneficial for crust freezing and other applications, it has been necessary to use one or more additional impingement chambers which impinge cold air or other cooling medium onto the product 16 before it enters or after it leaves the spiral chiller 2.

SUMMARY OF THE INVENTION

The present invention provides an improved spiral chiller and a method of chilling which satisfy the needs and alleviate the problems discussed above. The advantages and benefits provided by the inventive spiral chiller and chilling method include, but are not limited to: increased product throughput and reduced cooling or freezing times in the spiral chiller; uniform flow and temperature of the cooling medium along the entire length of the spiral conveyor; uniform cooling or freezing rates and product appearances across the entire width of the spiral belt; the ability to impinge or otherwise apply the cooling medium directly onto the top, bottom or both the top and the bottom of the product as it is being conveyed over one, more than one, or all of the spiral flites; the ability to change or adjust the degree of impingement by varying the speed of the chiller circulation fan and or changing delivery nozzles; greater energy efficiency and reduced generation of greenhouse gases; and the creation of new spiral methodologies which expand the use of spiral chilling to many additional food products and chilling applications and provide superior results and performance.

In one aspect, there is provided an improvement for a spiral chiller of a type for chilling food using a cooling medium wherein the spiral chiller comprises a product chilling chamber having a spiral conveyor in an interior of the product chilling chamber and the spiral conveyor has an upper end at an upper end elevation in the product chilling chamber, a lower end at a lower end elevation in the product chilling chamber, a plurality of spiral flites, and an axis of spiral travel. The improvement comprises a cooling medium delivery duct structure extending inside the interior of the product chilling chamber and having at least one discharge opening for discharging the cooling medium, wherein at least a portion of the discharge opening is elevationally located in the interior of the product chilling chamber below the upper end elevation and the discharge opening is oriented for discharging the cooling medium laterally in the product chilling chamber with respect to the axis of spiral travel.

As used herein and in the claims, the term chilling refers to and includes any type of product cooling, freezing, partial freezing, cold tempering, crust freezing, or other chilling operation.

In another aspect, there is provided an improvement for a spiral chiller of the type for chilling food using a cooling medium wherein the spiral chiller comprises a product chilling chamber having a spiral conveyor in an interior of the product chilling chamber and the spiral conveyor has an upper end at an upper end elevation, a lower end at a lower end elevation, a plurality of spiral flites, and an axis of spiral travel. The improvement comprises a cooling medium delivery duct structure extending downwardly inside the interior of the product chilling chamber and having a plurality of discharge openings in the interior of the product chilling chamber below the upper end elevation for discharging the cooling medium.

In another aspect, there is provided a method of chilling a food product in a spiral chiller. The method comprises the steps of: (a) conveying the food product on a spiral conveyor within an interior of a product chilling chamber of the spiral chiller, the spiral conveyor comprising a plurality of spiral flites along which the food product is carried and (b) conducting a cooling medium stream into the interior of the product chilling chamber via a delivery duct structure in the interior of the product chilling chamber which discharges at least a portion of the cooling medium stream into a vertical gap between an adjacent pair of the spiral flites.

In another aspect, there is provided a method of chilling a food product in a spiral chiller. The method comprises the steps of: (a) conveying the food product on a spiral conveyor within an interior of a product chilling chamber of the spiral chiller, the spiral conveyor comprising a plurality of spiral flites along which the food product is carried, the spiral flites being separated by vertical gaps; (b) conducting a first cooling medium stream into the product chilling chamber via a first delivery duct structure inside the interior of the product chilling chamber which discharges at least a portion of the first cooling medium stream into at least one of the vertical gaps; and (c) conducting a second cooling medium stream into the product chilling chamber via a second delivery duct structure inside the interior of the product chilling chamber which discharges at least a portion of the second cooling medium stream into at least one of the vertical gaps.

In another aspect, there is provided an improvement for a spiral chiller of the type for chilling food comprising a product chilling chamber having a spiral conveyor therein comprising a plurality of spiral flites. The improvement comprises a delivery duct structure in the product chilling chamber for receiving a stream of the cooling medium, the delivery duct structure including at least one discharge element which extends into a vertical gap between an adjacent pair of the spiral flites for discharging at least a portion of the cooling medium stream within the vertical gap. The improvement also preferably comprises the discharge element being configured for discharging at least a portion of the cooling medium stream downwardly, upwardly, or both downwardly and upwardly within the vertical gap.

In another aspect, there is provided an improvement for a spiral chiller of the type for chilling food comprising a product chilling chamber having a spiral conveyor therein comprising a plurality of spiral flites. The improvement comprises: (a) a first delivery duct structure in the product chilling chamber for receiving a first cooling medium stream, the first delivery duct structure including at least one discharge element that extends into, and is operable for discharging at least a portion of the first cooling medium stream within, a vertical gap between an adjacent pair of the spiral flites and (b) a second delivery duct structure in the cooling chamber for receiving a second cooling medium stream, the second delivery duct structure including at least one discharge element that extends into, and is operable for discharging at least a portion of the second cooling medium stream within, a vertical gap between an adjacent pair of the spiral flites.

In another aspect, there is provided a spiral chiller comprising; a product chilling chamber; a first spiral conveyor in the product chilling chamber; and a second spiral conveyor in the product chilling chamber. The second spiral conveyor travels above and in unison with the first spiral conveyor for conveying a food product in the product chilling chamber between the first and second spiral conveyors.

Further aspects, features, and advantages of the present invention will be apparent to those of ordinary skill in the art upon examining the accompanying drawings and upon reading the following detailed description of the preferred embodiments.

DETAILED DESCRIPTION OF THE PREFERRED EMBODIMENTS

Figure 1:
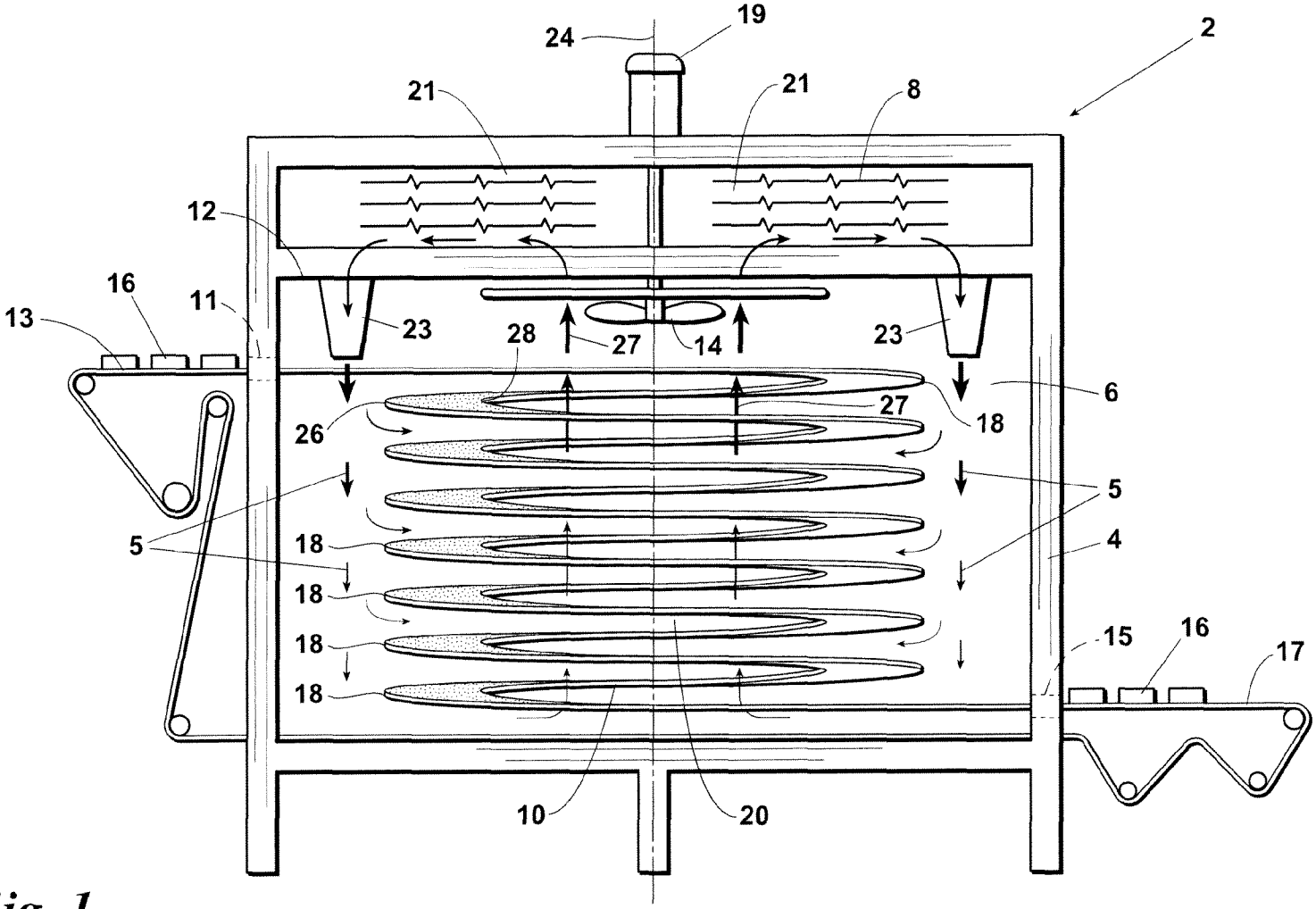
Fig. 1 ( PRIOR ART )
FIG. 1 is a cutaway elevational view illustrating a prior art spiral chiller 2.
Figure 2:
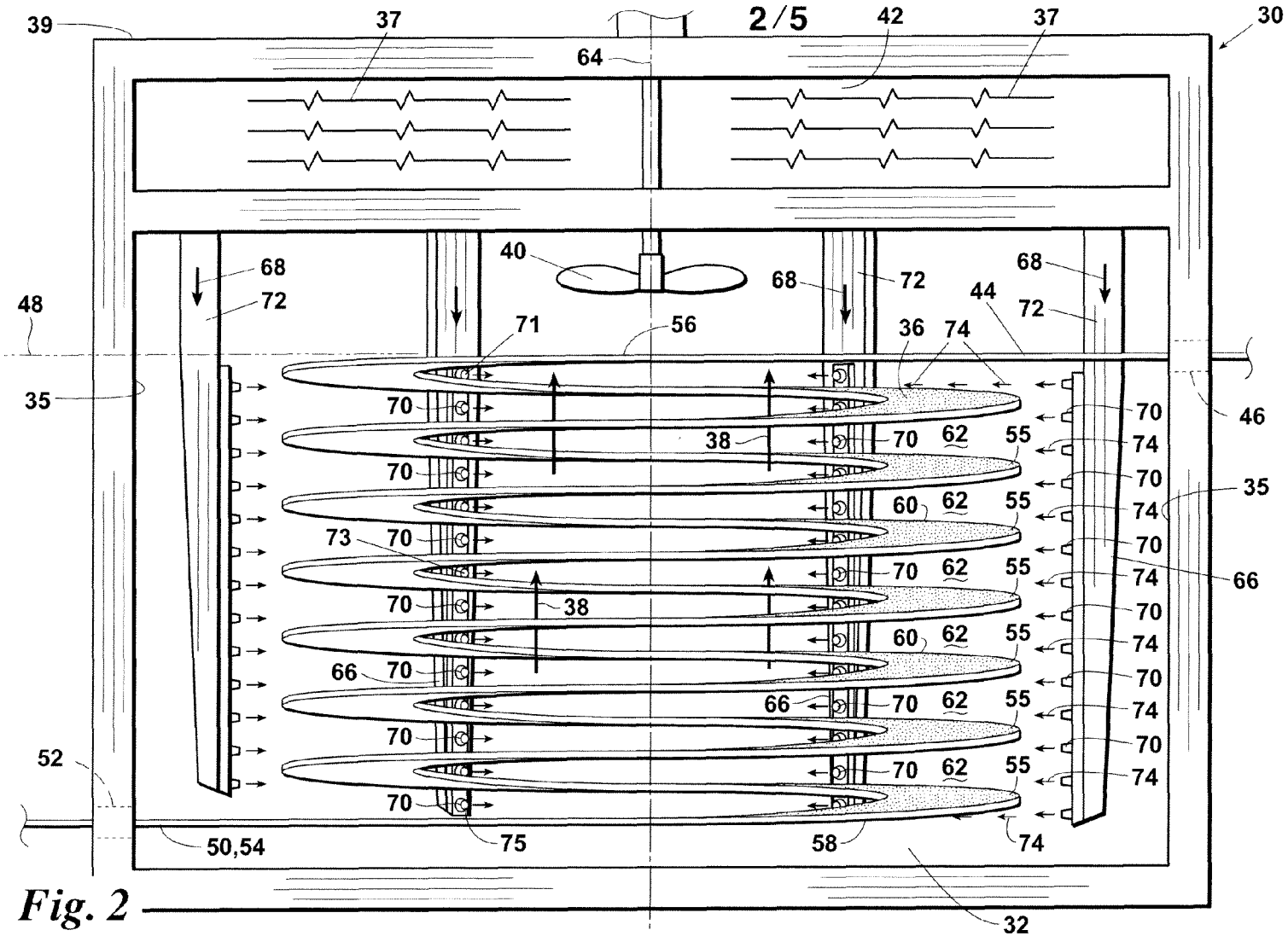
FIG. 2 is a cutaway elevational view illustrating a first embodiment 30 of the inventive spiral chiller.

An embodiment 30 of the improved spiral chiller provided by the present invention is illustrated in FIG. 2. As with the prior art chiller 2, the inventive spiral chiller 30 comprises: a product chilling chamber 32 having an interior chamber ceiling 34 and interior side walls 35; a spiral conveyor 36 within the interior of the product chilling chamber 32 below the ceiling 34; a vertical cooling medium return flow path 38 surrounded by the spiral conveyor 36; and a circulation fan 40 located above the spiral conveyor 36 for drawing the cooling medium upwardly through the return flow path 38 and delivering the cooling medium through any desired type of cooling or refrigerating element or system 37 in the upper chamber 42 and then into the product chilling chamber 32.

Although the housing 39 of the inventive chiller 30 includes both a product chilling chamber 32 and an upper chamber 42, it will be understood that the term "product chilling chamber," as used herein and in the claims, refers to the area of the chiller wherein the spiral conveyor 36 is located and the product is chilled and may refer to the entire chiller housing 39 or to a portion thereof.

The spiral conveyor 36 comprises: an upper end 44 which enters or leaves an upper opening 46 in the chiller housing and is located at an upper end elevation 48; a lower end 50 which enters or leaves a lower opening 52 through the chiller housing and is located at a lower end elevation 54; a series of spiral flites (360° revolutions) 55; a number of vertical gaps 62 such that a vertical gap 62 is provided between each adjacent pair of flites 55; and a longitudinal axis of spiral travel 64. The series of spiral flites 55 includes: an uppermost spiral flite 56; a lowermost spiral flite 58; and at least one, typically a plurality, of intermediate spiral flites 60 between the lowermost flite 58 and the uppermost flite 56. The series of 360° spiral conveyor flites 55 surround and thereby define the vertical cooling medium return flow path 38.

In contrast to the prior art chiller 2, the cooling medium is not circulated in the product chilling chamber 32 of the inventive chiller 30 simply by delivering the cooling medium vertically downward into the chamber 32 through one or more holes or short cones in the chamber ceiling 34. Rather, at least some, and preferably all, of the cooling medium is discharged into the interior of the product chilling chamber 32 by one or a plurality of delivery duct structures 66 which extend downwardly inside the interior of the chamber 32. The interior delivery duct structures 66 each receive a stream 68 of the cold cooling medium from the upper chamber 42 and discharge the cooling medium stream 68 at one or a plurality of locations within the product chilling chamber 32 below the upper end elevation 48 of the spiral conveyor 36.

The discharge openings 70 of the delivery duct structures 66 can be apertures, nozzle openings, slots, or any other type of opening effective for providing the amount, location, pattern, and upward, downward, or intermediate angle of flow desired. The opening(s) 70 will preferably extend below the upper end elevation 48 of the spiral conveyor 36. The opening(s) 70 will more preferably be elevationally located such that they extend downwardly in the product chilling chamber 32 at least to a lateral plane (i.e., a plane perpendicular to the axis of the spiral travel 64) which is at least 25%, 30%, 50%, or 65%, and most preferably at least 90%, of the distance downward from the upper end elevation 48 to the lower end elevation 54. In addition, the delivery ducts 66 and the opening(s) 70 provided therein can be identical or can be of differing lengths, configurations, arrangements, or sizes.

In the embodiment 30 shown in FIG. 2, the cooling medium delivery duct structures 66 each comprise an elongate vertical conduit 72 which is located outside of the spiral conveyor 36 and includes a vertical series of nozzles 70. The series of nozzles 70 extends along substantially the entire height of the spiral conveyor 36 from the upper end elevation 48 to the lower end elevation 54 and the nozzles 70 are directed for distributing and discharging the cooling medium stream 68 laterally inward toward the axis of spiral travel 64 (preferably at a lateral angle substantially perpendicular to the spiral axis 64 as illustrated by arrows 74) through the vertical gaps 62 and across the spiral flites 55.

The distribution of the cooling medium throughout the product chilling chamber 32 and the uniformity of flow and temperature therein can be further enhanced by deploying a plurality of delivery duct structures 66 around the outside of the spiral conveyor 36 at selected intervals. Further, the configuration of the ducts 66, as well as the size, nature, and spacing of the apertures, nozzles, or other discharge openings 70 of the delivery duct structures 66 can be varied as desired to promote more uniform flow throughout the product chilling chamber 32 and to ensure that an excessive amount of the cooling medium does not simply follow a short circuit path across the top of the product chilling chamber 32 to the circulation fan 40.

For example, in order to equalize the pressure drop experienced by the cooling medium following the short circuit path in the upper portion of the product chilling chamber 32 with that experienced by the cooling medium following the longer flow path through the bottom of the chamber 32, the size of the duct discharge openings 70 can be increased toward the bottom of the delivery duct 66. In this arrangement, an opening 75 located at the bottom end of the delivery duct 66 will be larger than an opening 71 nearest the top end and an opening 73 in the intermediate portion of the delivery duct 66 will also be larger than the upper end opening 71 but will be smaller than the lower end opening 75. Alternatively, or in addition, the spacing of the discharge openings 70 can be reduced toward the lower end of the delivery duct 66 such that more openings are provided per linear foot at the lower end of the duct 66 than nearest the upper end.

It will also be understood that, although the delivery ducts 66 of the inventive chiller 30 are positioned outside of the spiral conveyor 36, the flow pattern within the inventive chiller 30 could be reversed or otherwise changed such that the delivery duct(s) 66 extend downwardly inside the spiral flites 55 and discharge the cooling medium outwardly.

Figure 3:
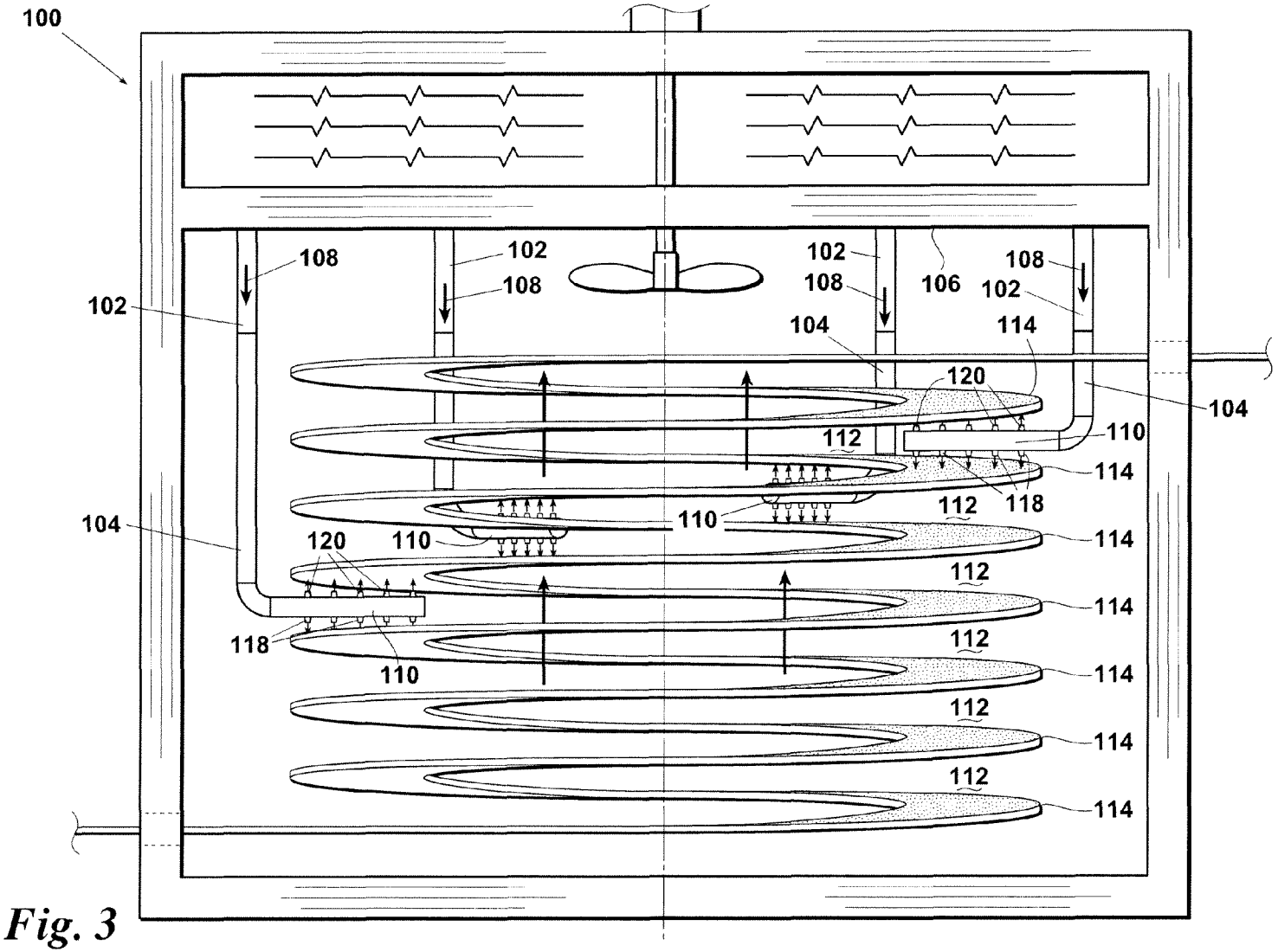
FIG. 3 is a cutaway elevational view illustrating a second embodiment 100 of the inventive spiral chiller.

A second embodiment 100 of the inventive improved spiral chiller is illustrated in FIG. 3. The spiral chiller 100 is identical to the spiral chiller 30 except for the configuration and operation of the one or more inventive cooling medium delivery duct structures 102 provided inside the interior of the product chilling chamber 105. Each delivery duct structure 102 employed in spiral chiller 100 includes: (a) a vertical leg 104 which extends downwardly from the cooking chamber ceiling 106 and receives a cold cooling medium stream 108 followed by (b) a lateral leg or other element 110 which extends into and discharges the cooling medium within one of the vertical gaps 112 provided between an adjacent pair of spiral flites 114. If more than one delivery duct structure 102 is employed, the lateral elements 110 of the various delivery duct structures 102 can extend into and discharge the cooling medium within the same vertical gap 112 or within other vertical gaps 112 provided between other adjacent pairs of spiral flites 114.

The delivery duct structures 102 employed in the inventive spiral chiller 100 are well suited for providing impingement chilling within the chiller. As illustrated in FIG. 3, the lateral element 110 of each delivery duct 102 will preferably have one or more apertures, nozzles, slots, or other openings 118 in the bottom thereof effective for discharging the cooling medium stream 108 downwardly onto the food product as it is being conveyed on the lower one of the adjacent pair of spiral flites 114. The lateral element 110 of the duct 102 will most preferably include a series of lower openings 118 which provide a uniform distribution of the cooling medium stream 108 across the entire width of the conveyor flite 116.

Alternatively, or in addition, one or more upper openings 120 can be provided in the same or different manner along the top of the lateral element 110 of the duct structure 102 for discharging at least a portion of the cooling medium stream 108 upwardly through the upper one of the adjacent pair of flites 114, assuming that a wire mesh or other open belt spiral conveyor 122 is used, onto the bottom of the food product as it is conveyed over the upper flite 114. The upper opening(s) 120 will also preferably provide uniform distribution of the cooling medium beneath the entire width of the upper conveyor flite 114.

The impingement velocity and the pattern provided in the inventive spiral chiller 100 can be varied as desired by adjusting the fan speed or by changing the number, size, shape, pattern, etc., of the lower and/or upper apertures, slots, nozzles, or other openings 118 and/or 120.

Figure 4:
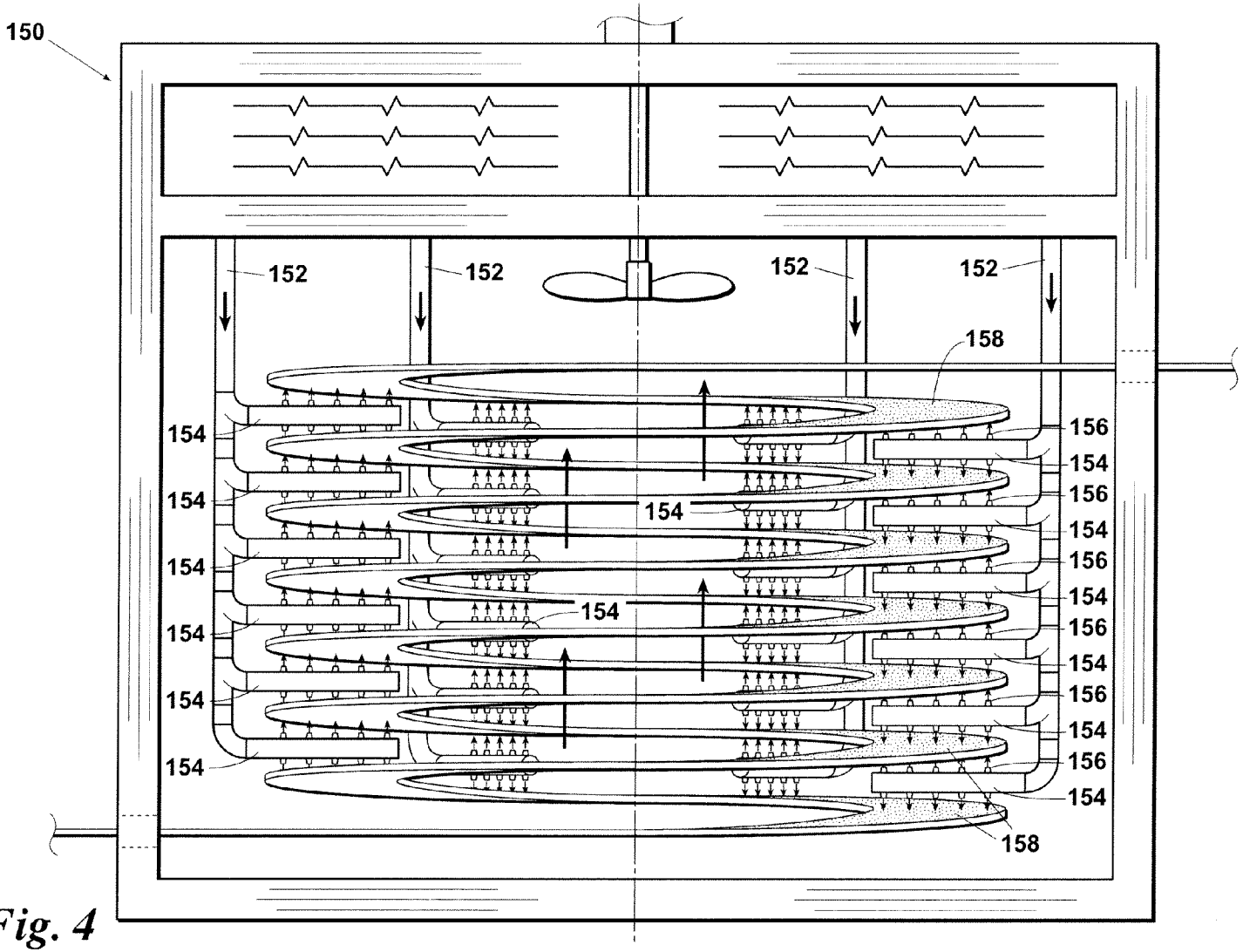
FIG. 4 is a cutaway elevational view illustrating a third embodiment 150 of the inventive spiral chiller.

A third embodiment 150 of the inventive spiral chiller is illustrated in FIG. 4. The inventive chiller 150 is identical to the inventive chiller 100 shown in FIG. 3 except that, rather than having only a single discharge element which extends between only one adjacent pair of spiral flites 158, the one or more delivery duct structures 152 of the inventive chiller 150 include multiple discharge legs or other elements 154 which extend into the vertical gaps 156 between at least two adjacent pairs, and most preferably between all adjacent pairs, of the spiral flites 158. Each of the discharge elements 154 illustrated in FIG. 4 is a lateral leg which is identical to the lateral leg 110 of the delivery duct structure 102 shown in FIG. 3 which extends from a vertical leg 152. The lateral discharge elements 154 are preferably effective for distributing the cooling medium across the entire width of the belt and for delivering the cooling medium either downwardly, upwardly, or both downwardly and upwardly in the vertical gaps 156.

Although the discharge elements 110 and 154 shown in FIGS. 3 and 4 comprise lateral pipe segments, it will be understood that the discharge elements 110 and 154 used in inventive chiller 100 and 150 can be of any desired type, shape, or discharge configuration effective for being received between a pair of adjacent spiral flites and for distributing the cooling medium stream over any desired area of the spiral conveyor belt and in any desired pattern.

Figure 5:
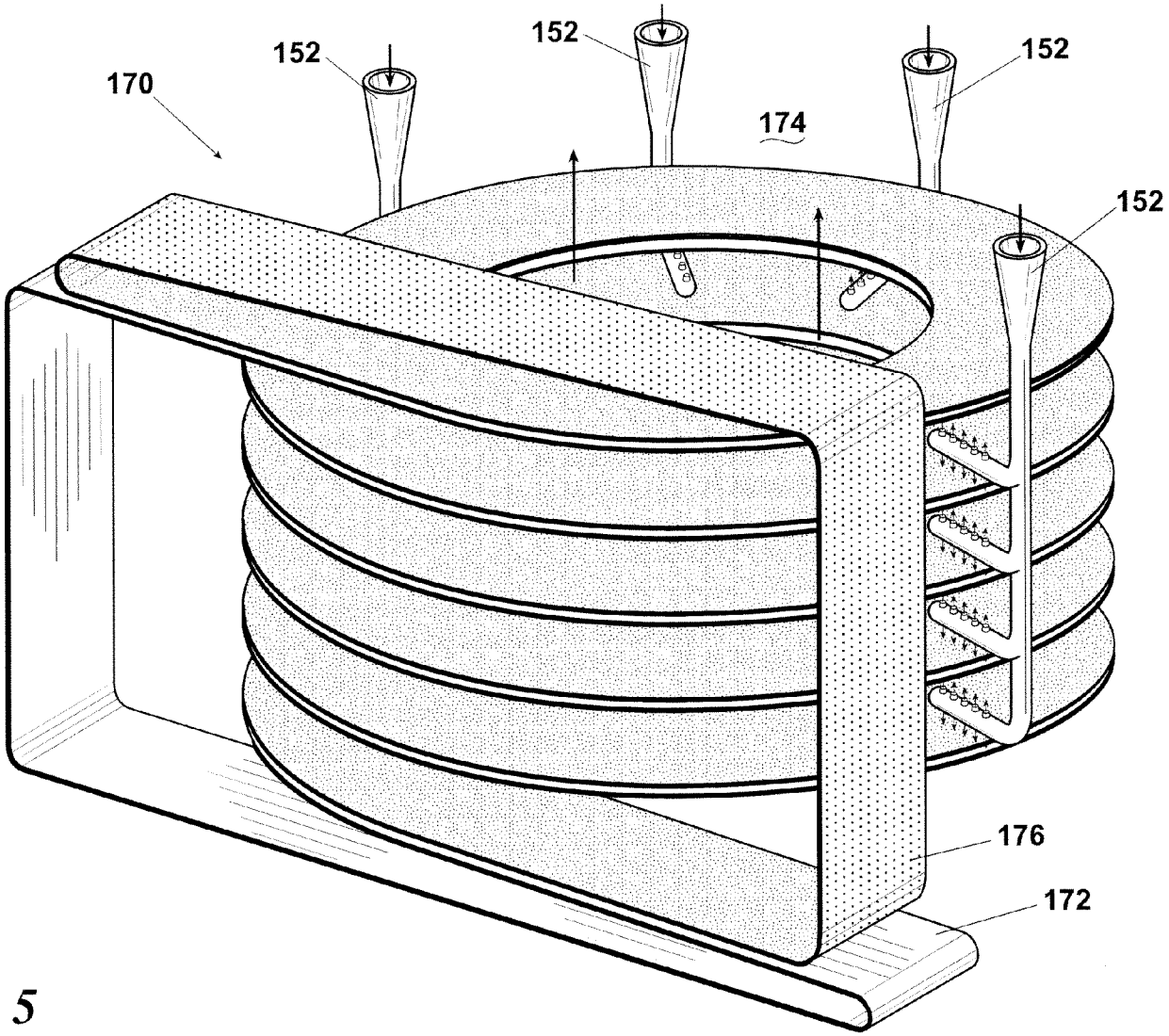
FIG. 5 is cutaway elevational view illustrating a fourth embodiment 170 of the inventive spiral chiller.

The product chilling chamber interior portion of a fourth embodiment 170 of the inventive improved spiral chiller is illustrated in FIG. 5. The inventive spiral chiller 170 is identical to the inventive spiral chiller 150 shown in FIG. 4 except that the inventive chiller 170 shown in FIG. 5 utilizes a unique and novel double belt arrangement. The double belt arrangement employed in inventive spiral chiller 170 is particularly well suited for the impingement and improved lateral flow operations provided by the present invention but is also well suited for use in other applications wherein, due for example to the nature of the food product and the cooling medium flow conditions within the spiral chiller, the food product is subject to movement and displacement on the spiral belt during the chilling operation.

The inventive spiral chiller 170 comprises both a first spiral conveyor 172 which runs through the product chilling chamber 174 and a second spiral conveyor 176 which travels within the product chilling chamber 174 above and in unison with the first conveyor 172. During operation, the food product is received and carried through the product chilling chamber 174 between the lower spiral belt 172 and the upper spiral belt 176. The spacing between the lower belt 172 and the upper belt 176 can be selected to correspond with the size and shape of the food product so that the upper belt 176 is effective for holding the food product in place on the lower belt 172. Also in accordance with the present invention, the upper spiral conveyor 176 and the lower spiral conveyor 172 will preferably each comprise a wire mesh or other open spiral belt which will allow the desired convective or impingement flow of the cooling medium through the upper belt 176 and/or the lower belt 172 onto the top and/or bottom surfaces of the food product.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the invention as defined by the claims.

What is claimed is:

1. A method of chilling a food product within a product chilling chamber of a spiral chiller, the method comprising the steps of:

discharging a cooling medium in a downward direction, in an upward direction, or in both the downward and upward directions from a first plurality of spaced-apart discharge openings located along a first lateral leg of a first conduit, the first lateral leg of the first conduit extending into a vertical gap defined by two adjacent flites of a spiral conveyor and spanning an entire width of the spiral conveyor between a first inner and a first outer edge, an amount of the cooling medium being discharged along the length of the first lateral leg of the first conduit being a greater amount toward the first inner edge of the spiral conveyor than toward the first outer edge; and discharging a cooling medium in a downward direction, in an upward direction, or in both the downward and upward directions from a second plurality of spaced-apart discharge openings located along a second lateral leg of a second conduit, the second conduit being independent of the first conduit, the second lateral leg of the second conduit being at a different vertical elevation than that of the first conduit and extending into a different vertical gap defined by a different two adjacent flutes of the spiral conveyor and spanning an entire width of the spiral conveyor between a second inner and a second outer edge, an amount of the cooling medium being discharged along the length of the second lateral leg of the second conduit being a greater amount toward the second inner edge of the spiral conveyor than toward the second outer edge;

wherein the size, horizontal spacing, or size and horizontal spacing of the discharge openings of the first lateral leg and the second lateral leg are arranged so the amount of cooling medium discharged by the plurality of the first spaced-apart discharge openings and by the plurality of the second spaced apart discharge openings located along the first lateral leg and the second lateral leg, respectively, provides a uniform cooling rate across a respective entire width of the spiral conveyor and equalizes a pressure drop of a flow path of cooling medium originating from the first lateral leg of the first conduit with that of the second lateral leg of the second conduit.

* * * * *